US005716539A

United States Patent [19]

Brickner

[11] Patent Number: 5,716,539

[45] Date of Patent: Feb. 10, 1998

[54] CONCRETE RAILROAD TIE MOLD INSERT FOR RAIL FASTENERS

[75] Inventor: Peter S. Brickner, Spokane, Wash.

[73] Assignee: CXT Incorporated, Spokane, Wash.

[21] Appl. No.: 541,240

[22] Filed: Oct. 12, 1995

[51] Int. Cl.[6] ..... B28B 23/00

[52] U.S. Cl. ..... 249/86; 249/94; 249/97; 249/134

[58] Field of Search ..... 249/86, 91, 93, 249/94, 96, 97, 134; 264/275, 278

[56] References Cited

U.S. PATENT DOCUMENTS

| | | | |
|---|---|---|---|
| 1,782,813 | 11/1930 | Ferriera | 249/97 |
| 3,471,118 | 10/1969 | Bormann et al. | 249/86 |
| 3,503,584 | 3/1970 | Erhart et al. | 249/97 |
| 3,685,782 | 8/1972 | Kowell | 249/94 |
| 3,685,783 | 8/1972 | Hilson | 249/86 |
| 4,106,745 | 8/1978 | Carrow | 249/97 |

FOREIGN PATENT DOCUMENTS

| | | | |
|---|---|---|---|
| 2462985 | 2/1981 | Germany | 249/86 |

*Primary Examiner*—Jay H. Woo
*Assistant Examiner*—Joseph Leyson
*Attorney, Agent, or Firm*—Wells, St. John, Roberts, Gregory & Matkin PS

[57] ABSTRACT

An insert is described for attachment to a concrete railroad tie mold within an opening formed therein. The insert is adapted to releasably receive and position a railroad rail fastener with a head end positioned below the mold and an anchor part projecting into the mold. The insert includes an insert body including an outward peripheral edge surface shaped to fit within the formed first opening in the railroad tie mold, and an internal peripheral edge surface defining a fastener receiving opening, situated inwardly of the outward peripheral edge surface. The insert body further includes a top surface that is held in substantial coplanar relation to an adjacent mold bottom surface. A clip arrangement provided on the insert body functions to releasably secure the insert body to the mold with the top surface of the insert body being substantially coplanar with the bottom mold wall. An adapter may be provided on the mold to facilitate mounting and positioning of the insert on the mold.

16 Claims, 6 Drawing Sheets

Fig 9
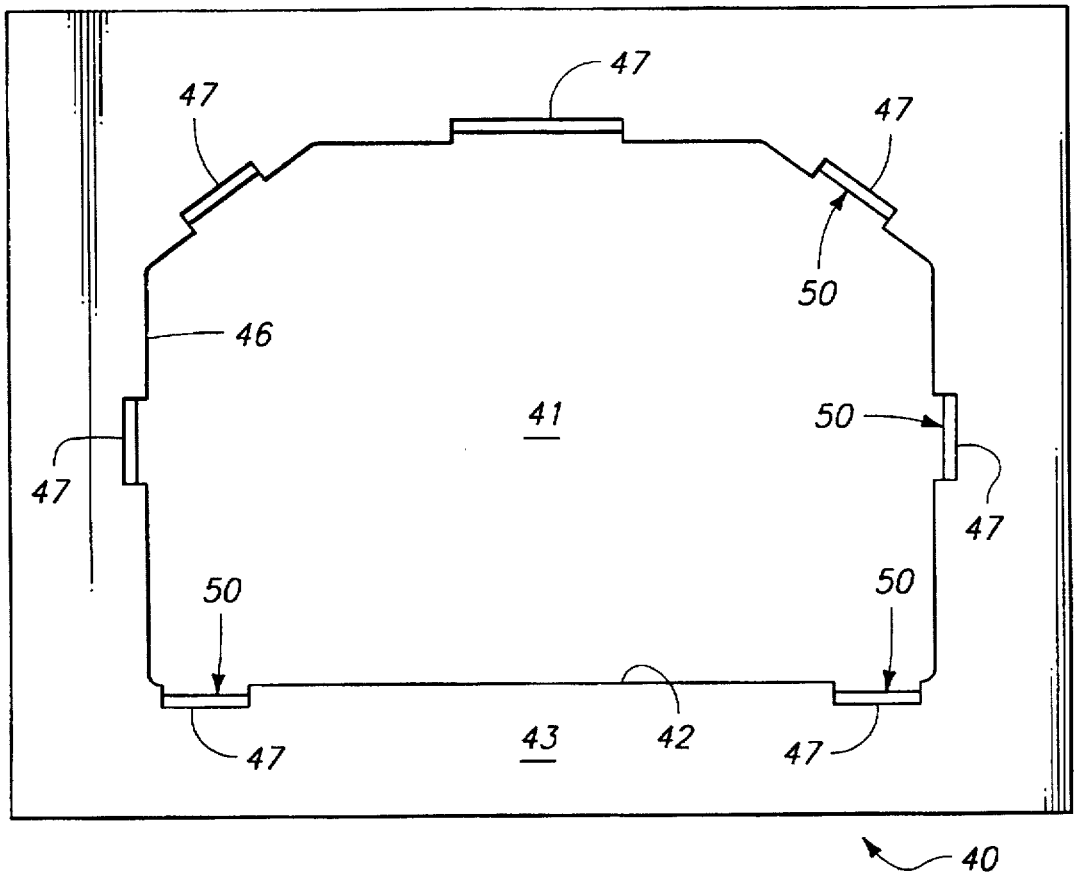
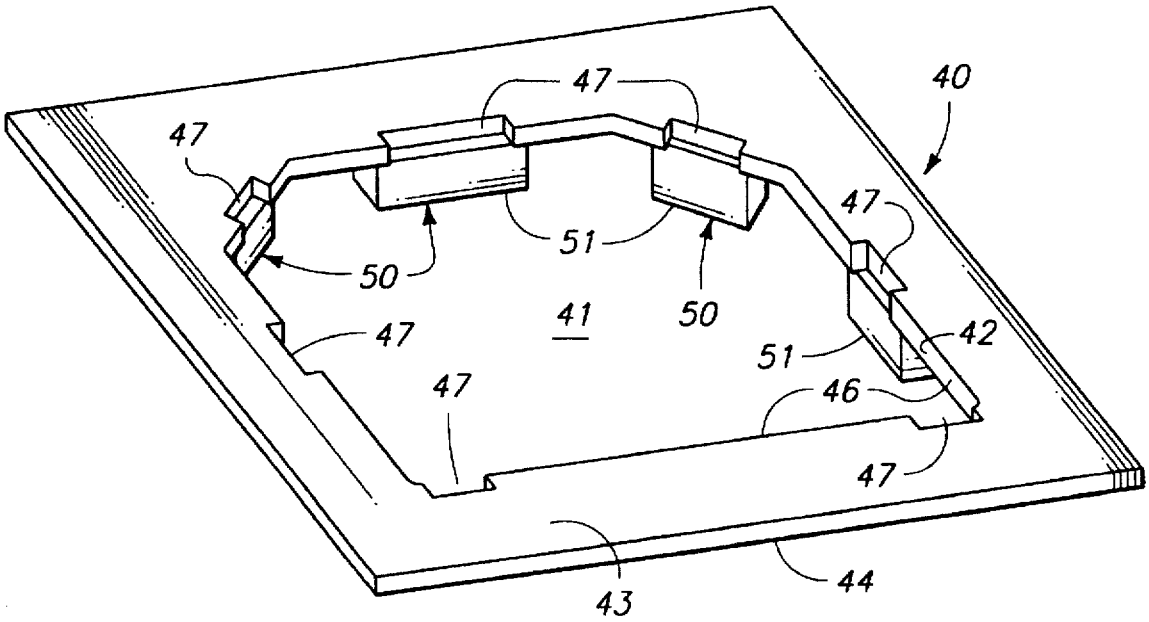
Fig 10

CONCRETE RAILROAD TIE MOLD INSERT FOR RAIL FASTENERS

TECHNICAL FIELD

The present invention relates to positioning of rail fasteners within concrete railroad tie molds.

BACKGROUND OF THE INVENTION

Numerous forms of rail fasteners are provided to be set in concrete railroad ties, for holding railroad rails in place. The fasteners typically are formed of cast steel and include a rail fastening head part that projects above the tie, and an anchor part that is held securely within the concrete of the tie. The fasteners are positioned within openings in the molds, with the anchor parts projecting into the mold cavity. Concrete conforms to and secures the anchor parts as the tie is formed in the tie mold.

It is crucial that the fasteners be precisely located along the length of the ties. This is a problem in mass production of ties, especially if the ties are to be prestressed using pretensioned reinforcing steel rods. Prestressed rods have a tendency to cause the ties to shrink slightly in length when the prestressing tension is removed. This slight longitudinal compaction in turn causes the fasteners to shift slightly longitudinally within the tie molds.

To allow for such shrinkage or movement, positioner fittings (some being constructed of rubber, others of plastic materials) are bolted to brackets below the bottom surface of the tie molds. This leaves the metal edge of the fastener openings exposed to wear and to damage by the fasteners during the "de-molding" process when the cured tie is pulled, along with the fasteners, from the mold. The fittings eventually wear and require replacement. This is a long and tedious procedure, and causes the tie mold to be removed from service. If the fittings cannot be repaired, replacement is a costly and time consuming process.

Further, if it is not noticed that the fittings need maintenance, it is not unusual that the fasteners will hang up on the molds during de-molding (pulling the cured concrete tie from the mold) and damage the mold. Now the whole mold requires repair before it can be returned to service.

A need has thus been realized for an insert that will take the place of fastener positioning fittings, that will accurately position the fasteners, that can be installed without taking the tie molds from service, that will protect the mold during de-molding operations, and that is relatively inexpensive to use. These needs are filled by the insert described and claimed herein.

BRIEF DESCRIPTION OF THE DRAWINGS

Preferred embodiments of the invention are described below with reference to the accompanying drawings, which are briefly described below.

FIG. 9 is a plan view of an adapter for mounting the insert to the tie mold;

FIG. 10 is a perspective view of the adapter;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 12:
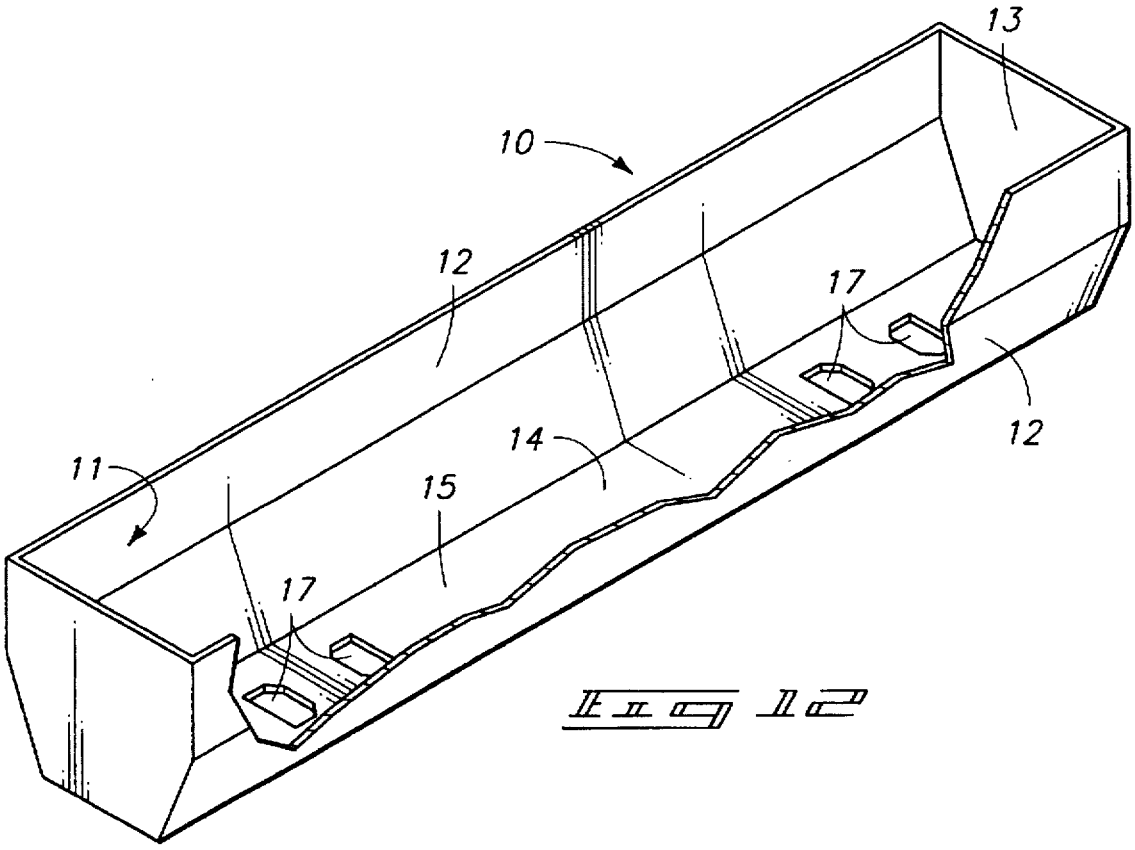
FIG. 12 is a diagrammatic perspective view of a tie mold.

In FIG. 12, a concrete railroad tie mold 10 is shown. Though only one mold is shown, it should be understood that numbers of such molds may be interconnected in frames (not shown) commonly used in mass production systems. The mold 10 includes a rigid elongated body 11 with a recess shaped to receive and form concrete into the desired shape for a concrete railroad tie. In general, the overall shape of the mold is not critical to the present invention, it being understood that various shapes are utilized to produce as many different concrete railroad tie configurations, and that the present insert and insert assembly can be readily adapted for use with, or to be manufactured along with, many, if not all, conventional tie molds.

Figure 11:
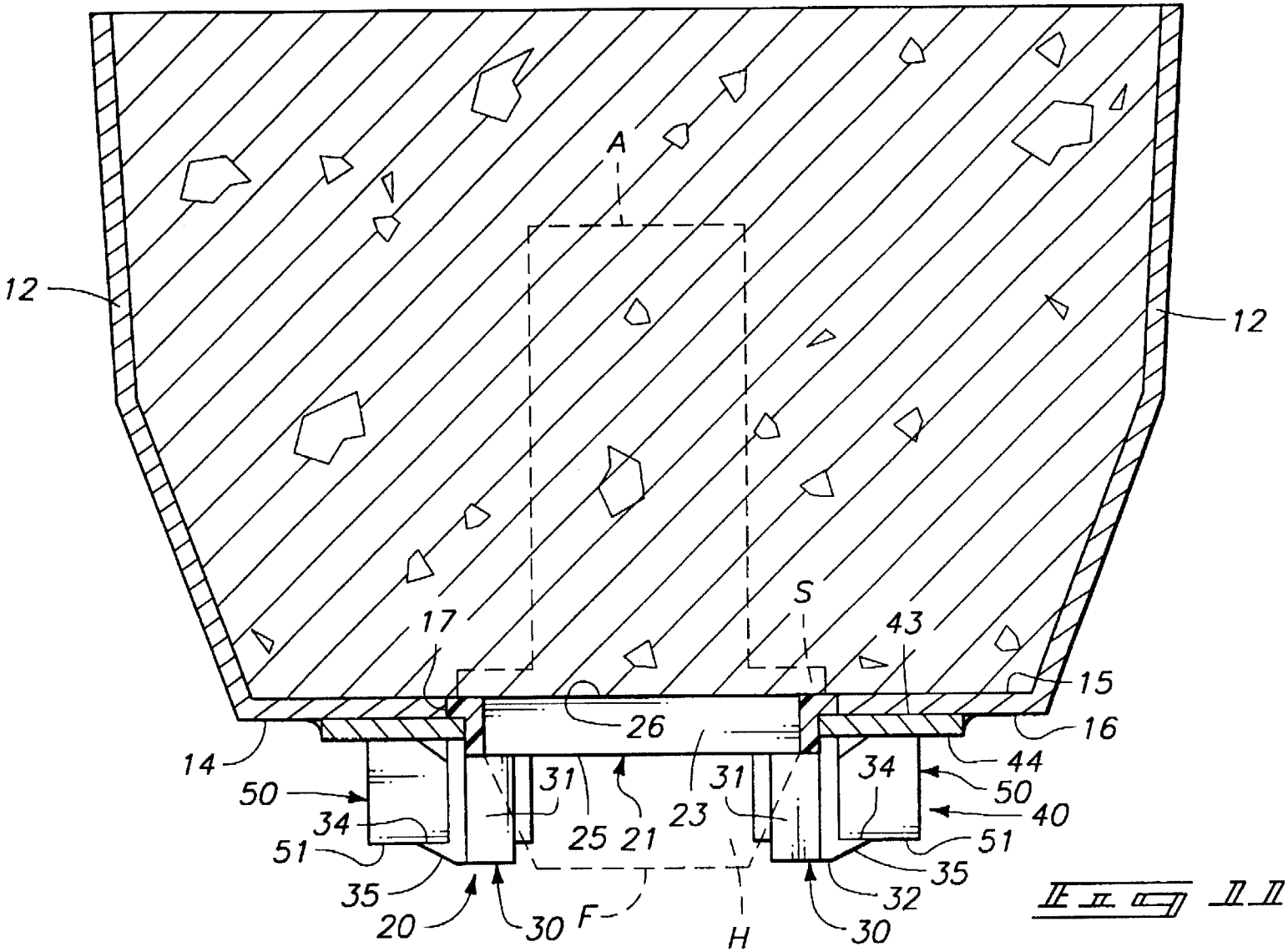
FIG. 11 is a sectional view of a concrete tie mold with a tie formed therein, with the adapter and insert mounted to the mold, and with a rail fastener diagrammatically shown by dashed lines.

An exemplary mold 10 is shown in transverse cross section in FIG. 11, filled with concrete to produce a tie. The mold is shown empty in FIG. 12.

Figure 13:
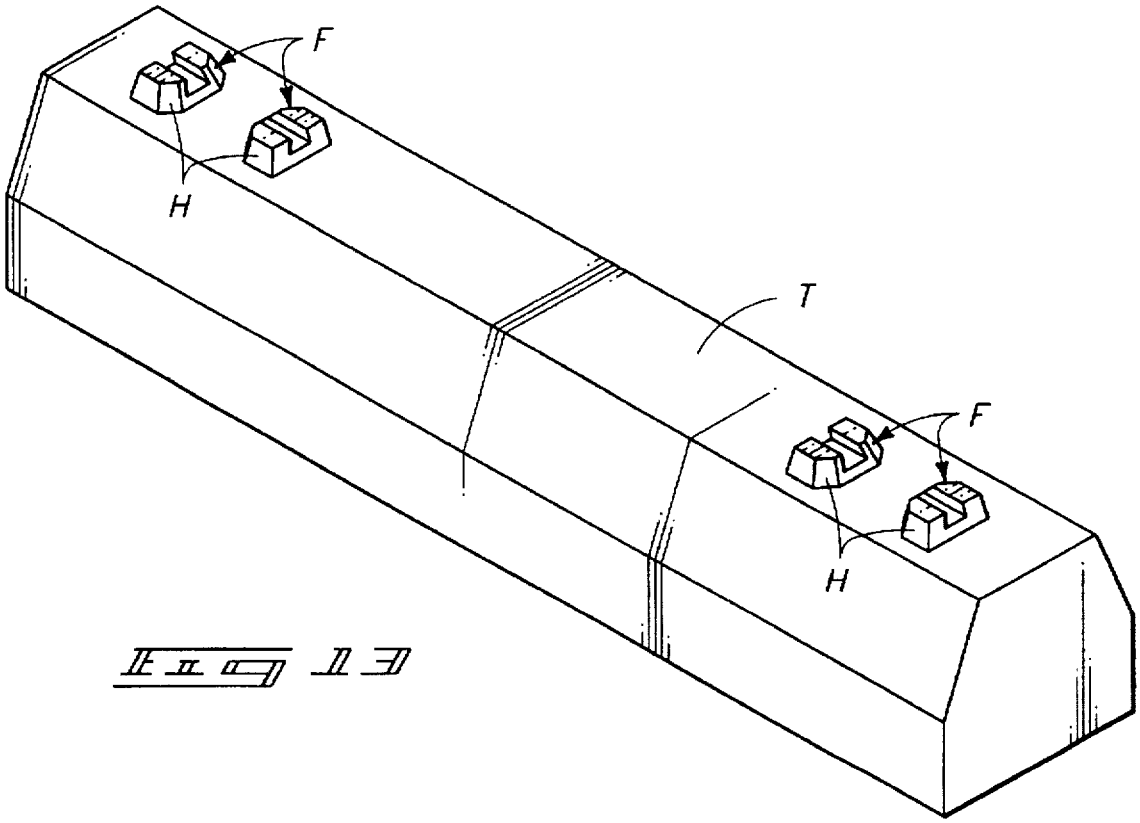
FIG. 13 is a diagrammatic perspective view of a concrete tie with fasteners mounted thereon.

In general, the mold 10 includes elongated side walls 12 that shape the side walls of the tie T (FIG. 13). The mold also includes fixed or removable end walls 13 that form the tie ends. The mold further includes a bottom wall 14 that defines the top surface of the tie.

Tie molds are typically inverted as shown and are poured full of concrete through the open top mold side. This side determines the thickness of the tie according to the depth of concrete poured into the mold. Thus the bottom surface of the tie is not typically formed by a mold surface.

The bottom mold wall 14, for purposes of further discussion below, includes a top surface 15 and a bottom surface 16 (FIG. 11). In a typical mold, four formed first openings 17 are provided to receive and situate four rail fasteners F, one of which is shown graphically in FIG. 11.

Fastener F is shown graphically and does not form part of the present invention. However, to better understand the present invention, a brief discussion of an exemplary fastener will be given. The fastener F as shown in FIG. 11 is typically a solid body formed of cast steel, including a rail fastening head H separated by a shoulder S from an anchor part A.

The formed first openings 17 in the mold 10 are shaped to receive the fastening head H, such that the shoulder S rests against the top surface 15 of the mold bottom wall 14. The fastening head H thus projects below the mold bottom wall so it will be exposed above the top surface of the finished tie. The anchor part A extends upwardly into the mold to be covered with concrete, thus becoming securely and immovably imbedded in the finished tie. It is a function of the present invention to position the fastener F within the mold and in the mold opening in an accurate manner, while protecting the mold against wear and damage by the fastener head during de-molding (the process of removing the finished, cured tie and embedded fasteners from the mold).

A first preferred form of the present insert is shown generally at 20 in the drawings. It is noted that the insert 20 may be provided alone, for mounting to existing concrete tie molds; as a retrofit kit, with an adapter 40 for more selective mounting to existing tie molds; or may be supplied as replaceable units in combination with manufactured tie molds.

It is also noted, as indicated above, that various forms of rail fasteners F are produced. The shape of the insert 20 may thus vary according to the fasteners in use.

In a presently preferred form, the insert 20 is formed of a plastic resin, preferably by injection molding. More preferably, the plastic is a polyamide resin, and most preferably a nylon type 66. An exemplary nylon material is "ZYTEL 101" brand, sold by DuPont. It has been found that such material includes desirable strength and elasticity properties suited for use in the present inserts 20.

Figure 6:
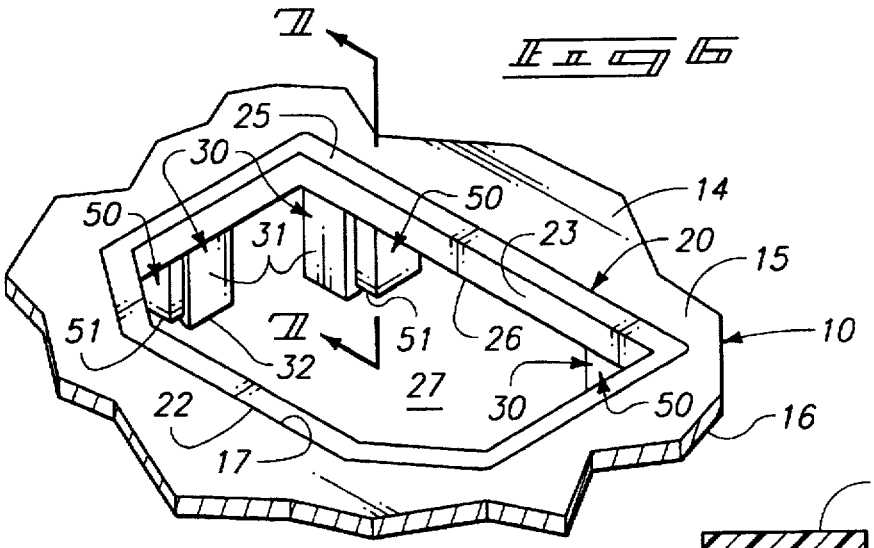
FIG. 6 is a fragmented perspective view of the preferred insert in place within a concrete tie mold.

The preferred insert includes an insert body 21 that is defined about its exterior by an outward peripheral edge 22. The edge 22 is complementary to the openings 17 formed within the tie mold bottom wall 14. The openings shown are exemplary, as are the external shapes of the inserts to be used. Other insert shapes could be also used to fit within similarly shaped openings. The peripheral edges of the inserts are shaped to closely yet slidably fit the formed first openings of the mold, as shown in FIG. 6.

The insert body also includes an internal peripheral edge surface 23, defining a fastener receiving opening 27, situated inwardly of the outward peripheral edge surface 22. The fastener receiving opening is similar in shape to the cross-sectional configuration of the fastener F being used. Thus the inserts may be produced in various shapes depending upon the configuration of fasteners to be used.

The external and internal edge surfaces 22, 23 extend between respective top and bottom surfaces 25, 26 of the insert body. The distance between the top and bottom insert surfaces 25, 26 may be considered the thickness dimension of the insert body 21.

A recess 24 is formed about the external perimeter and within the thickness dimension of the insert body. The recess 24 is shaped to receive a shoulder 46 of an adapter 40 that will be described in greater detail later in this specification.

The insert also includes means, including for example a clip 30 for releasably securing the insert body 21 to the concrete railroad tie mold 10 with the top surface 25 of the insert body 21 substantially coplanar with the bottom mold wall 14. More specifically, the insert top surface 25 is preferably held substantially co-planar with the top surface 15 of the mold bottom wall 14 by the clip 30 and the recess 24.

In a preferred form, the clip 30 includes at least one elongated leg 31 projecting downwardly in opposition to the insert body 21. In the example shown, several legs 31 are provided about the perimeter of the insert, all projecting downwardly from the insert body to remote leg ends 32. At each of the leg ends 32, a catch section 33 is provided, with a catch surface 34 and an inclined cam surface 35 thereon. The catch surfaces 34 are substantially parallel to and face the top surface 25 of the insert. The cam surfaces are inclined up and outwardly from the leg ends 32 to facilitate insertion of the insert into one of the first mold openings 17.

The leg sections 31 are resilient to permit lateral motion of the catch sections, thus enabling them to operatively engage and disengage the railroad tie mold. In the preferred form, the insert body 21, legs 31 and catch sections 33 are integral and formed of the same material described above.

In a preferred form, an adapter 40 is provided along with the insert, for attachment to the tie mold 10, and for aiding in accurately and securely positioning the inserts along the mold bottom wall. One of the adapters 40 is provided for each of the mold first openings 17 and is fastened, by welding or other appropriate fastening means, to the mold bottom wall 14. The adapters 40 releasably receive the insert clips 30 through the associated mold opening 17.

The adapters 40 may be formed separately from the mold 10 as shown, or alternatively may be formed substantially integrally with the molds.

In the preferred form shown, each adapter 40 is formed of metal plate, preferably steel. The adapter includes a formed second opening 41 defined by a closed edge surface 42. The edge surface 42 extends between top and bottom adapter surfaces 43, 44. The top adapter surface 43 is adapted for mounting to the tie mold, specifically the bottom wall 14.

Figure 1:
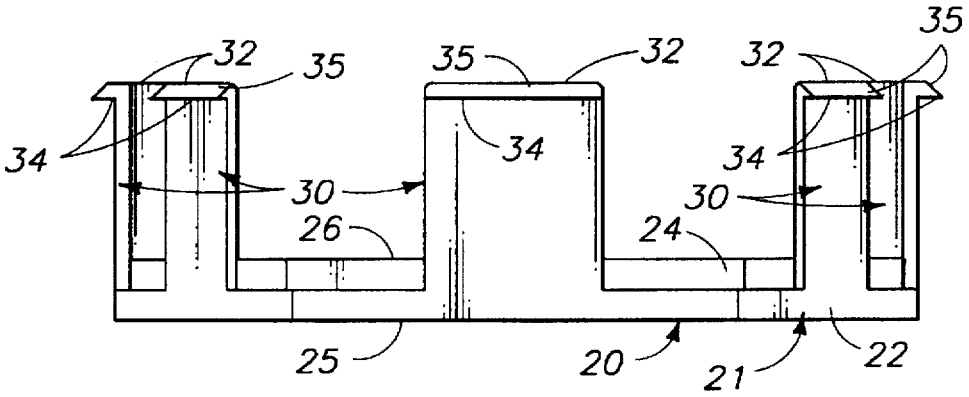
FIG. 1 is a side elevation view of a first preferred form of the present insert.
Figure 2:
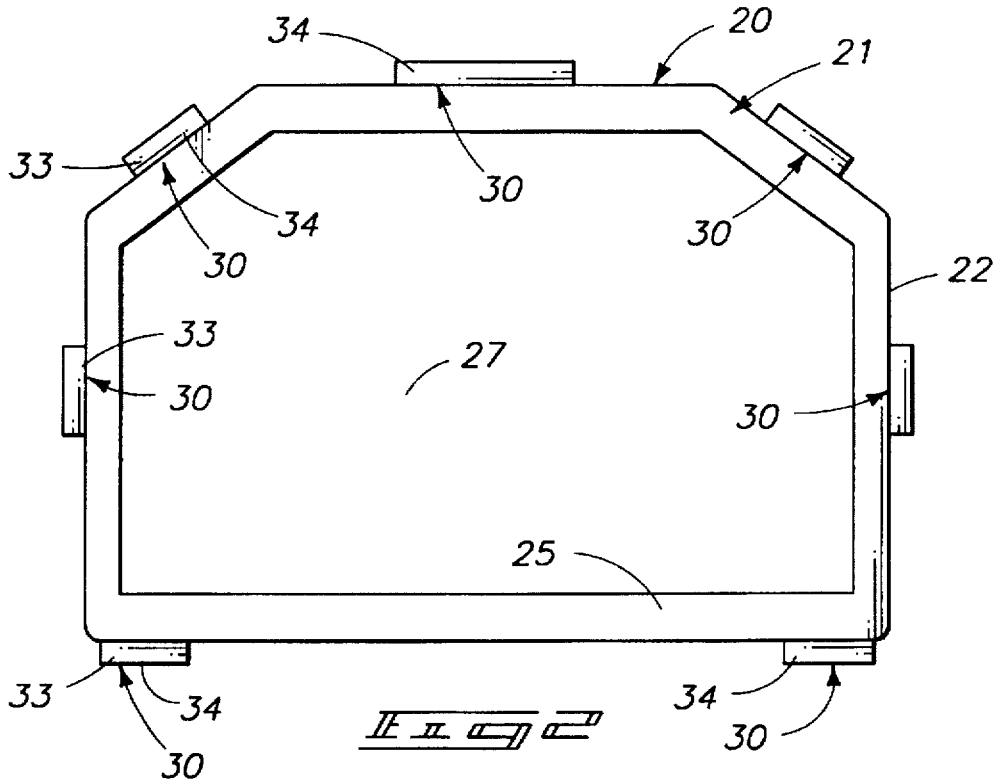
FIG. 2 is a top plan view thereof.
Figure 3:
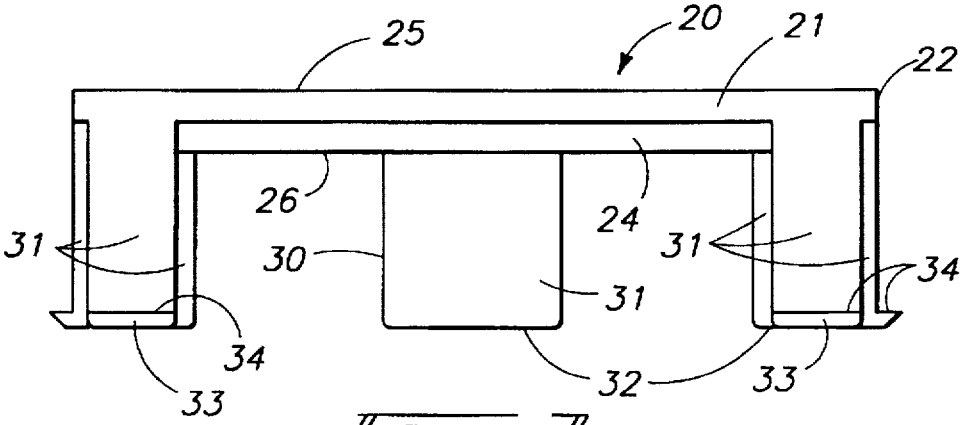
FIG. 3 is an opposite side elevation view thereof.
Figure 4:
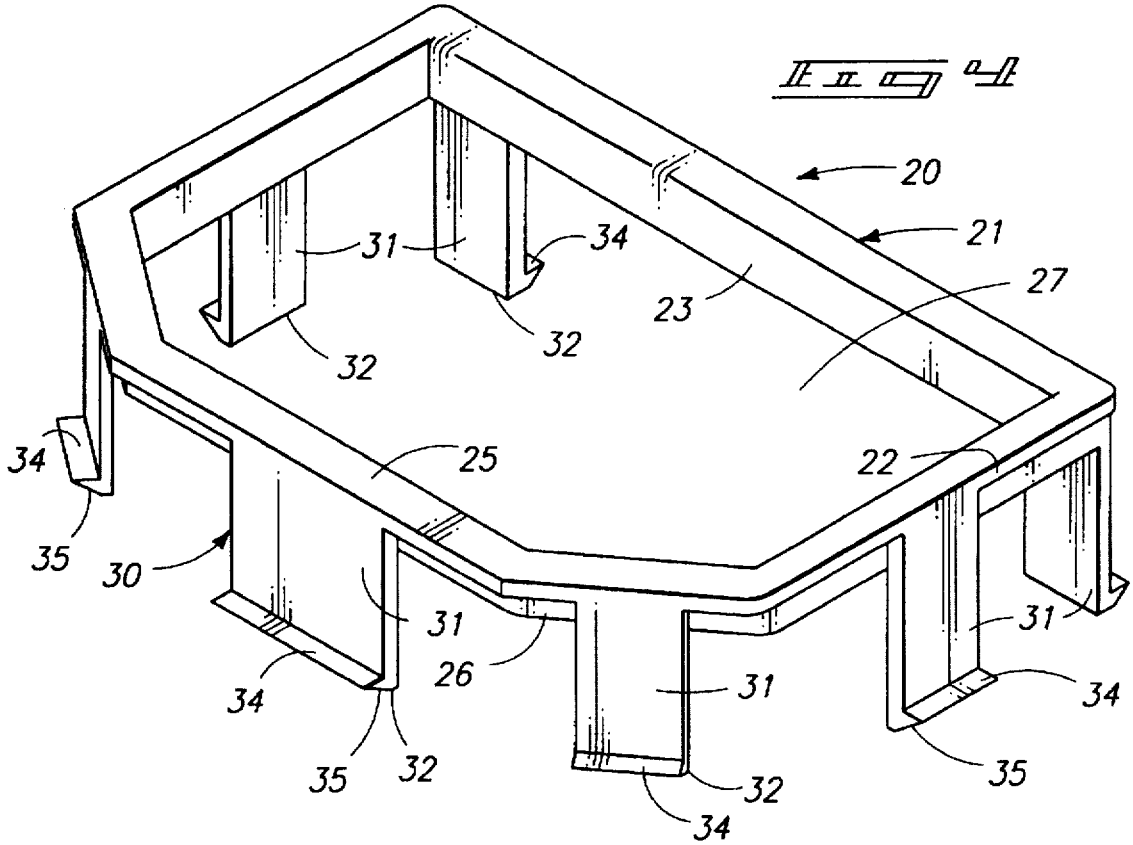
FIG. 4 is a perspective view thereof.
Figure 5:
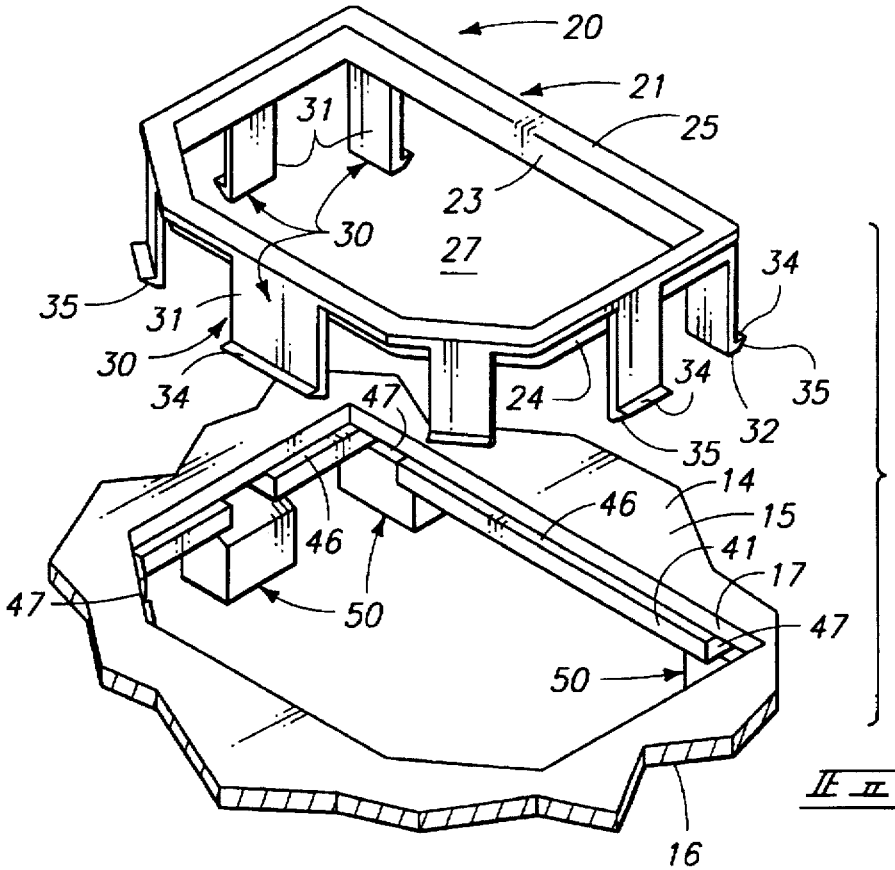
FIG. 5 is a fragmented exploded perspective view illustrating positioning of the present insert into a concrete tie mold.

The second opening 41, defined by closed edge surface 42, is of similar shape but of smaller size than the first opening 17 formed through the mold bottom wall 14. The adapter is mounted with the second opening 41 substantially centered directly below the first opening 17, such that a shoulder 46 (FIG. 5) is formed by the adapter adjacent the bottom surface 16 of the bottom tie mold wall 14 inwardly of the first opening 17.

Figure 7:
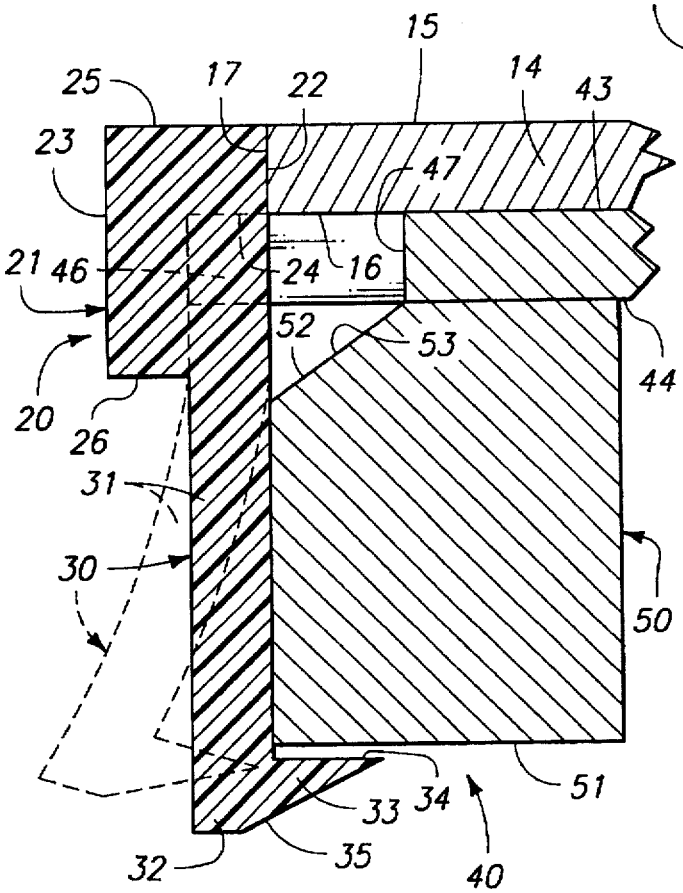
FIG. 7 is an enlarged sectional view taken substantially along line 7—7 in FIG. 6.

The shoulder 46 abuts the insert within the peripheral recess 24 briefly described above. The shoulder 46 prevents the whole of the insert body 21 from passing through the first opening 17 in a downward direction, and aids to position the top surface 25 of the insert body in substantial co-planar relation to the top surface 15 of the bottom mold wall (FIG. 7).

Indentations 47 are formed in the adapter plate along the closed edge surface 42, matching the spacing of the clip legs 31. The indentations thus allow the legs 31 to pass downwardly beyond the bottom surface of the plate to clip engaging surfaces 51.

The clip engaging surfaces 51 are provided in a preferred form on spacer blocks 50, located adjacent the closed edge surface. The clip engaging surfaces 51 releasably receive the clip catch surfaces 34 when the insert is properly positioned in the mold.

It is noted that the spacer blocks 50 may be omitted from the adapter. In such an arrangement, the legs 31 of the clips would be shortened so the catch surfaces 34 would snap into engagement with the bottom surface 44 of the adapter plate. However, it is preferred that the spacer blocks be provided in order to allow for longer catch legs 31 as shown. Longer legs are more flexible along their lengths and thus ease installation and removal of the inserts to and from the tie mold.

Figure 8B:
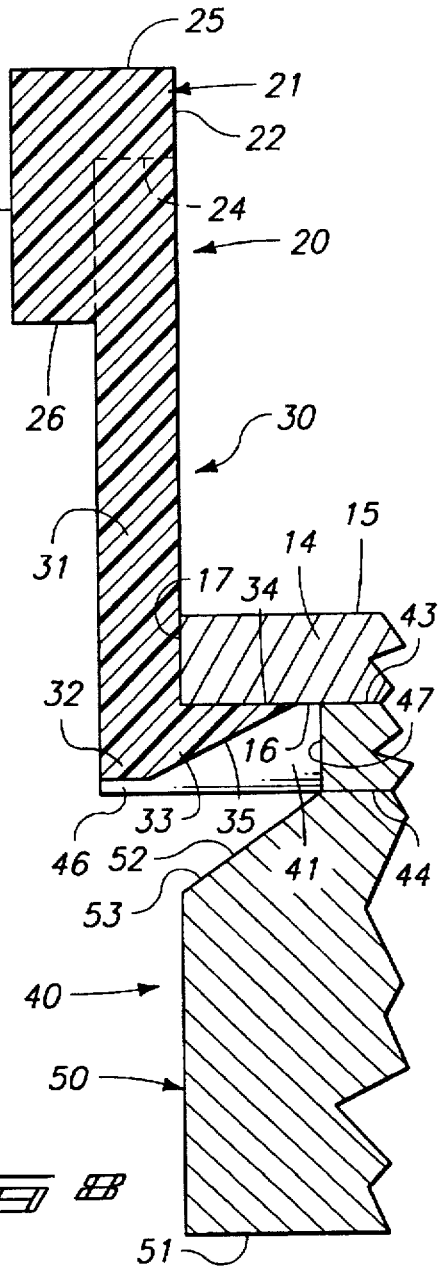
FIG. 8 is a view similar to FIG. 7 only showing the sectioned piece of the present insert partially retracted from the mold.

In a preferred form, a notch 52 (FIGS. 7, 8) is provided along each spacer block 50, spaced upwardly from the clip engaging catch surface 51 and adjacent the bottom adapter surface 44 (FIGS. 7, 8). The notch is formed by an inclined surface 53, angled similarly to the angled cam surface 35.

The notch is provided to releasably receive the clip catch section 33 (FIG. 8), as a secondary stop to prevent the insert from being unintentionally withdrawn from the mold, a possibility during the de-molding process when the cast tie and fasteners are pulled from the mold.

Given the above technical description, operation of the present invention may now be understood.

Operation will be described assuming the tie mold has been produced or modified to include the shaped first openings 17, and the inserts 20 have been produced to match the openings and the form of fasteners to be used. The adapters are centered under the openings and are welded or otherwise secured to the mold. The adapters may be secured in this manner to existing molds, or may be assembled with the mold during the mold manufacturing process. Installation of the inserts thus becomes a first step in the tie pouring operation, along with oiling the form.

The inserts are easily and quickly mounted to the form simply by pressing the inserts legs first through the first openings 17. As the inserts are pressed downwardly, the cam surfaces 35 engage and slide over the opening edges, camming each of the resilient legs inwardly to the configuration shown by dashed lines in FIG. 7. When fully depressed, the peripheral recesses 24 on each insert body receive the adapter shoulders 46, and the catch surfaces snap over the clip engaging surfaces 51, as shown by solid lines in FIG. 7. The inserts are now installed and ready to receive fasteners.

Fasteners F are installed head first, downwardly through the openings 27 in the inserts. It is noted here that the fasteners never touch the edge surfaces of the bottom mold wall openings 17, since these edges are now covered and protected by the inserts 20. The fasteners are accurately positioned by the inserts, with the heads H projecting below the bottom mold wall 14. Appropriate clamping devices (not shown) may now be employed to secure the fasteners in position, with the anchor parts A projecting into the mold cavity. Reinforcing rods (also not shown) may be installed and pretensioned at this point. The mold is now ready to pour.

Wet concrete is poured into the mold cavity and is finished to the level of the side wall 12 top edges. The wet concrete will form about the fastener anchors A, but will not seep through the first mold openings 17 or the insert openings 27 due to the close proximity of the insert to the mold opening edges, and the close contact between the fasteners and the internal peripheral edges 23 of the inserts. The concrete is now allowed to cure, hardening about the fastener anchors and thereby rigidly securing them in place.

If the reinforcing rods have been pretensioned, as in most quality concrete tie forming operations, the pre-applied tension is removed once the concrete has cured to a desired hardness. This procedure results in a small determinable amount of longitudinal "shrinkage" of the tie, shifting the fasteners slightly in a longitudinal direction. The nature of the selected materials for the insert allows for such movement by flexing with the slightly moving fasteners. The inserts, being positioned between the fasteners and adjacent edge surfaces of the bottom mold wall openings 14 again function at this point to protect the mold from damage by the shifting fasteners.

The de-molding process is completed once the tie has sufficiently cured within the mold. This may be accomplished in a number of ways known in the industry, but ultimately results in the cured tie being pulled or otherwise separated from the mold. Of course the fasteners, now secured by the cured concrete, are pulled along with the tie from the mold. As this happens, the fastener heads slide upwardly over the plastic surfaces of the inserts. The inserts protect the mold against abrasion against the edges of the mold openings 17.

It is not uncommon for a tie to become slightly angularly canted with respect to the mold during the de-molding operation. In the past before advent of the present invention, it was not unusual for the canted fasteners to catch on the side edges of the mold openings and bend or otherwise damage the mold bottom walls. This immediately took the mold from service for repair or replacement. With the present inserts, such damage is avoided by the plastic insert body.

If the fastener catches or binds within the associated insert upon de-molding, two possibilities occur. First, the insert may become scored or misshaped by the fastener. This is readily remedied by simply replacing the insert before the next tie is poured. This can be easily done as indicated above without requiring removal of the mold from service. Secondly, it may be that sufficient separation forces are present to cause the insert to be pulled from its presently seated position. If this occurs, the catch sections 33 will slide upwardly over the spacer blocks and snap into the notches 52 (FIG. 8). The catch sections will stop upward progress of the insert in this partially retracted position and likely strip the insert from the retracting fastener head, again without permitting damage to the mold. The insert, if undamaged, can then be tapped back into position in readiness for the next casting operation.

It is understood that the inserts will eventually wear and require replacement. Such wear however is isolated within the inserts which are significantly less expensive and cumbersome to deal with than the molds, or the previously used fastener positioning apparatus. Replacement inserts are considerably less expensive and do not require removal of the mold from service. Worn inserts may be removed simply by bending the clip legs 31 inwardly to disengage the catch sections 33 from the spacer blocks, and pulling the insert upwardly from the mold. This process may be completed by hand. The new insert can then be installed from above the mold, in the manner described above, in a quick and efficient manner.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A railroad rail fastener positioning insert for a concrete railroad tie mold having a formed first opening through a bottom mold wall and an adapter having a shoulder with an indentation on the bottom mold wall projecting into the opening, the insert comprising:

an insert body including an outward peripheral edge surface shaped to fit within the formed first opening in the railroad tie mold;

the insert body including a top surface;

the insert body further including an internal peripheral edge surface defining a railroad rail fastener receiving opening shaped to slidably receive a railroad rail fastener, the internal peripheral edge surface being situated inwardly of the outward peripheral edge surface;

a recess formed in the insert body and spaced from the top surface to receive the shoulder on the bottom mold wall and locate the top surface of the body substantially coplanar with the bottom mold wall;

a clip on the insert body positioned to project through the formed first opening and the indentation and operatively engage a bottom surface of the adapter.

2. A railroad rail fastener positioning insert for concrete railroad tie molds as claimed by claim 1, wherein the insert body is formed of a polyamide resin.

3. A railroad rail fastener positioning insert for concrete railroad tie molds as claimed by claim 1, wherein the recess and clip are integral with the insert body.

4. A railroad rail fastener positioning insert for concrete railroad tie molds as claimed by claim 1, wherein the recess and clip are integral with the insert body and said insert body is formed of plastic resin.

5. A railroad rail fastener positioning insert for concrete railroad tie molds as claimed by claim 1, wherein said clip includes an elongated leg section extending from the insert body to a remote end, and a catch section at the remote end of the leg section with a catch surface thereon substantially parallel to and facing the top surface, the leg section being resilient to permit lateral motion of the catch section to operatively engage and disengage the bottom surface of the adapter.

6. A railroad rail fastener positioning attachment assembly for mounting to a concrete railroad tie mold having a formed first opening through a bottom mold wall, comprising:

an insert body including an outward peripheral edge surface of complimentary shape to the formed first opening in the railroad tie mold;

the insert body including a top surface;

the insert body further including an internal peripheral edge surface defining a fastener receiving opening, situated inwardly of the outward peripheral edge surface;

wherein the insert body is shaped to be received within the first opening with the top surface of the insert body being substantially coplanar with the bottom mold wall and includes a recess spaced from the top surface;

an adapter including a formed second opening defined by a closed edge surface with an indentation and further including top and bottom adapter surfaces joined by the closed edge surface, the top adapter surface being adapted for mounting to the railroad tie mold to define a shoulder which mates with the recess; and a clip on the insert body and projecting in opposition to the top surface thereof to project through the indentation, engageable with the bottom adapter surface of the adapter to releasably secure the insert body to the railroad tie mold.

7. A railroad rail fastener positioning attachment assembly as claimed by claim 6, wherein the bottom adapter surface includes a spacer block adjacent the closed edge surface, with a clip engaging surface thereon for releasable engagement by the clip.

8. A railroad rail fastener positioning attachment assembly as claimed by claim 6, wherein the bottom adapter surface includes a spacer block adjacent the closed edge surface, with a clip engaging surface thereon for releasable engagement by the clip, and a notch spaced from the catch surface for releasably receiving the clip.

9. A railroad rail fastener positioning attachment assembly as claimed by claim 6 wherein the insert body is formed of a thermoplastic material.

10. A railroad rail fastener positioning attachment assembly as claimed by claim 6 wherein the insert body is formed of nylon 66.

11. A railroad rail fastener positioning attachment assembly as claimed by claim 6, wherein the adapter is formed from a rigid metal.

12. A railroad rail fastener positioning attachment assembly as claimed by claim 6, wherein the clip includes an elongated leg section extending from the insert body to a remote end, and a catch section at the remote end of the leg section with a catch surface thereon substantially parallel to and facing the top surface, the leg section being resilient to permit lateral motion of the catch section to operatively engage and disengage the bottom adapter surface.

13. A railroad tie mold, comprising:

a rigid tie mold body including a mold cavity defined by side, end and bottom tie mold walls in the shape of a desired railroad tie;

wherein the bottom tie mold wall includes a top surface and a bottom surface, with a first opening formed therethrough;

an insert body including an outward peripheral edge surface of complimentary shape to the first opening;

the insert body including a top surface;

the insert body further including an internal peripheral edge surface defining a fastener receiving opening, situated inwardly of the outward peripheral edge surface, and a recess spaced from the top surface thereof;

wherein the insert body is received within the first opening with the outward peripheral edge surface within the first opening of the tie mold body, and the top surface of the insert body being substantially coplanar with the top surface of the tie mold bottom wall;

an adapter including a formed second opening, defined by a closed edge surface with an indentation, of similar shape but of smaller size than the first opening, and further including top and bottom adapter surfaces joined by the closed edge surface, the top adapter surface being mounted to the bottom surface of the tie mold bottom wall to define a shoulder which mates with the recess; and a clip on the insert body and projecting in opposition to the top surface thereof to project through the indentation, engageable with the bottom adapter surface of the adapter to releasably secure the insert body to the rigid mold body with the top surface of the insert body substantially coplanar with the top surface of the tie mold bottom wall.

14. A railroad tie mold as claimed by claim 13, wherein the insert body is formed of nylon 66.

15. A railroad tie mold as claimed by claim 13, wherein the bottom adapter surface includes a spacer block adjacent the closed edge surface, with a clip engaging surface thereon for releasable engagement by the clip, and a notch spaced from the catch surface for releasably receiving the clip.

16. A railroad tie mold, comprising:

a rigid mold body including an adapter and a mold cavity defined by side, end and bottom mold walls;

wherein the bottom mold wall includes a top surface and a bottom surface, with a first opening formed therethrough;

said adapter integrated with the bottom surface and including a shoulder with an indentation projecting into the first opening;

an insert body including an outward peripheral edge surface of complimentary shape to the first opening;

the insert body including a top surface;

the insert body further including an internal peripheral edge surface defining a fastener receiving opening, situated inwardly of the outward peripheral edge surface thereof, and a recess spaced from the top surface thereof;

wherein the insert body is received within the first opening with the outward peripheral edge surface adjacent the first opening and said shoulder mates with said recess; and a clip on the insert body projecting through the indentation and operably engageable with the adapter for releasably securing the insert body to the rigid mold body with the top surface of the insert body substantially coplanar with the top surface of the mold bottom wall.

* * * * *